United States Patent [19]

Meier et al.

[11] Patent Number: 4,707,021

[45] Date of Patent: Nov. 17, 1987

[54] ENCLOSURE PANEL FOR TRACTOR

[75] Inventors: Lynn A. Meier, East Dubuque, Ill.; Arvid H. Saele, Peosta, Iowa

[73] Assignee: Deere & Company, Moline, Ill.

[21] Appl. No.: 926,710

[22] Filed: Nov. 4, 1986

[51] Int. Cl.[4] ..... B60J 9/00; E05C 3/24

[52] U.S. Cl. ..... 296/196; 180/69.24; 220/325; 292/63; 292/64; 292/212; 292/90; 292/115

[58] Field of Search ..... 296/193, 194, 196, 198; 180/69.24; 292/90, 115, 212, 63, 64, 69; 220/325

[56] References Cited

U.S. PATENT DOCUMENTS

| | | | |
|---|---|---|---|
| 1,062,075 | 5/1913 | Arens | 292/212 |
| 3,774,946 | 11/1973 | Hammann | 292/64 |
| 4,071,107 | 1/1978 | Leighty | 180/69.24 |
| 4,137,983 | 2/1979 | Gray | 180/69.24 |

*Primary Examiner*—Dennis H. Pedder

[57] ABSTRACT

A latch on a panel closing an opening in which the panel overlaps an edge portion forming the opening comprising a U-shaped channel with a short leg resting against the panel and the long leg extending behind the edge portion and including a bolt extending through the panel and short leg and threadedly attached to the long leg.

6 Claims, 4 Drawing Figures

ENCLOSURE PANEL FOR TRACTOR

BACKGROUND OF THE INVENTION

This invention relates to a mounting of and the latches on a side panel of a tractor in the area of the engine of the tractor. The side panel has horizontal flanges at its upper and lower edges. The lower flange has openings along the flange to receive lugs on the tractor for mounting the lower portion of the shield on the tractor. Adjacent the upper flange of the panel are one or more latches that hold the upper portion of the panel on the tractor. Each latch is composed of a formed channel with one long and one short leg. A hole is punched through both legs with a nut welded to the long leg. A cap screw is inserted through the side shield and both channel legs so that the long leg is away from the panel. As the cap screw is tightened, the long leg is drawn up to the mating part, in this case the inner surface of the hood portion of the tractor. As the cap screw is loosened, the long leg of the channel relaxes moving away from the mating part. A lock nut is added to the end of the cap screw to prevent the first time user from backing the cap screw completely out when it is desired to remove the shield.

The upper edge of the short leg is positioned adjacent the upper flange on the shield. One corner of the upper edge is rounded and the cap screw is positioned on the channel so that it is relatively close to the side of the channel under the rounded corner. The purpose of having the rounded corner is to permit the cap screw, when it is being tightened in order to reduce the distance between the two leg portions, to shift the channel vertically and to have the rounded corner miss the flange until the other corner or edge contacts the lower surface of the flange on the shield. Conversely, when it is decided to loosen the channel, the rounded corner swings clear of the flange.

One of the important advantages of the present latch mechanism is the appearance it gives to the shield or panel when the latches are positioned for latching. A simple latch with an external handle would be clearly visible to a typical vandal. However, the side shield attachment of this invention gives a conventional bolted joint appearance which is beyond the intent level of the typical vandal out to simply cause damage.

Another advantage is that the head of the cap screw or bolt is sized for commonly carried open-end wrenches or an adjustable wrench. No keys are required. Wrench turning is minimized since the part is so balanced that drag between the screw and nut will rotate the latch both when loosening and tightening. All the parts are fixed to the side panel assembly thereby eliminating loose and lost hardware when the panel is removed.

DESCRIPTION OF THE PREFERRED EMBODIMENT

Figure 1:
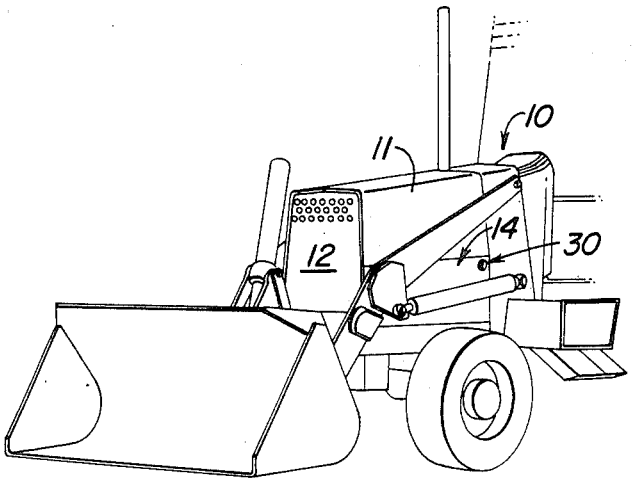
FIG. 1 is a front view of a tractor and loader combination with the tractor using the side shield of the present invention.
Figure 2:
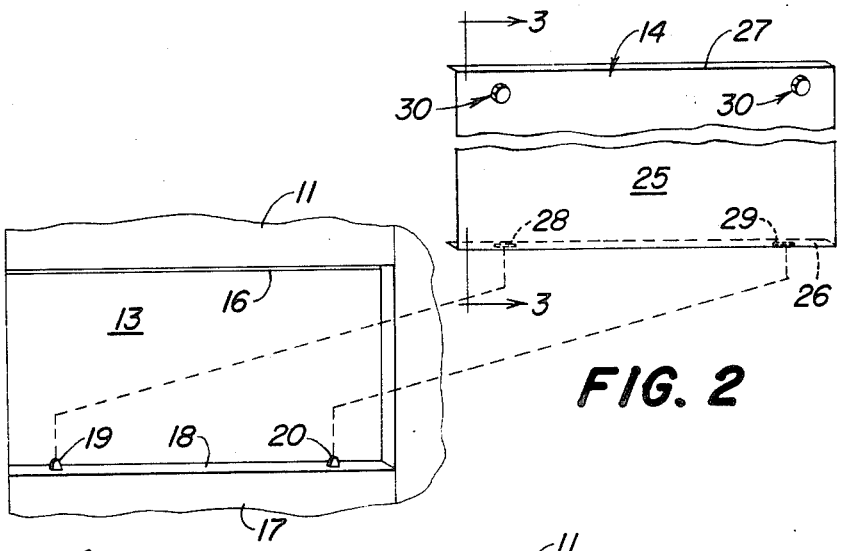
FIG. 2 is a composite view of the opening in the tractor body and the relationship of the opening to its closing shield.

Referring now to the drawings, a tractor 10 is provided with a U-shaped hood panel 11 that extends over the engine portion of the tractor. A grill 12 is positioned at the front end of the tractor. The tractor 10 has on its left side an access opening, indicated generally at 13 in FIG. 2, which is closed by a side shield 14. The opening 13 is bordered at its upper edge by a Z-shaped flange 15 on the hood 11 and ending in a vertical leg section 16. At the lower edge of the opening 13 there is provided a tractor portion 17 which has at its upper edge an inwardly extending horizontal section 18, which in turn has a pair of fore-and-aft spaced apart vertical lugs 19, 20.

The closure panel 14 is composed of a main upright panel portion 25 having a lower inwardly projecting flange 26 and an upper inwardly extending flange 27 generally normal to the surface of the panel 14. The flanges 26, 27 extend the fully length of the panel 25. The lower flange 26 has fore-and-aft spaced apart slots 28, 29, spaced on the order of the lugs 19, 20. The upper flange 27 overlaps the leg section 16. As is clearly apparent from viewing FIGS. 2 and 3, the shield 14 is first mounted in the opening 13 by moving the slots 28, 29 to a position where they receive the respective lugs 19, 20. This generally mounts the lower edge of the shield 14 on the tractor.

Figure 3:
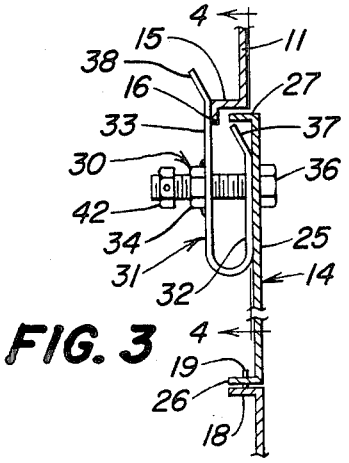
FIG. 3 is a vertical sectional view taken substantially along the line 3—3 of FIG. 2 and showing the shield or cover when it is almost entirely in place.
Figure 4:
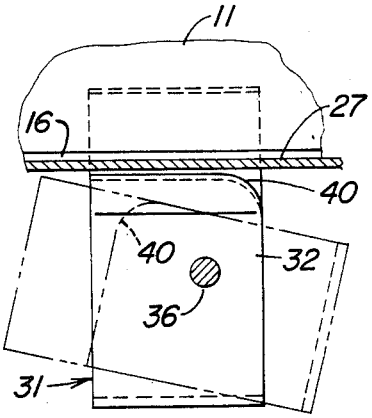
FIG. 4 is a view taken along the line 4—4 of FIG. 3 and showing the latching channel in upright and lower positions.

Apair of latches 30 are carried by the main upright panel 25 adjacent each upper corner thereof and spacedly under but close to the inwardly extending upper flange 27. Since both latches are identical, reference will be made only to the forwardmost latch 30 as shown in FIGS. 3 and 4. The latch 30 includes a basic U-shaped channel 31 with a short leg 32 and a long leg 33. When properly positioned, the long leg 33 is positioned behind the vertical panel portion 16 of the Z-shaped edge 15. The shorter leg 32 is positioned so that that its upper edge is closely adjacent the flange 27. Upper portions 37, 38 of legs 32, 33 are flared inwardly so as to make the movement of the channel 31 more adaptable, vertically with respect to insertion behind the panel section 16. The short and long legs 32, 33 have horizontal and axially aligned openings therein with the opening in the long leg 33 having a threaded member or nut 34 welded to its inner surface and in coaxially alignment with the openings in both leg portions 32, 33. Extending through the main vertical panel portion 25 and through the respective openings in the shorter and longer legs 32, 33 is a threaded stud 36 that is threaded into the nut 34. It should here be noted that the flange 27 is positioned so that its innermost edge is opposite the plate panel 16 of the Z-shaped lower edge 15. As the stud 36 is tightened, the two legs 32, 33 will draw together thereby forcing the flange 27 to move toward and in some instances to contact the outer surface of the vertical edge section 16.

Referring now to FIG. 4, the upper right-hand corner of the shorter leg 32 is rounded, as at 40, and the stud 36 is offset to the right of center and generally beneath the corner 40. As is apparent from reviewing the drawing, as the stud 36 is tightened, the drag between the stud 36 and the nut 34 will cause the channel 31 to rotate in a clockwise direction. The corner 40 will permit that portion of the shorter leg 32 to move to the right until the remainder of the edge or the opposite corner contacts the flange 27. This prevents further shifting or rotation about the axis of the stud 36. Conversely, when it is desired to loosen the latch, it is necessary to loosen the stud 36. The natural drag between the stud 36 and the bolt 34 will cause the entire channel 31 to move in a counterclockwise direction. The rounded corner 40 will permit the channel 31 to move into a position in which the entire channel 40 is out of contact with any of the edges of the flanges or openings. The bight end of channel 31 coming in contact with flange 27 will, of course, limit counterclockwise rotation of the channel.

A torque lock nut 42 is added to the end of the threaded stud 36 in order to prevent the user who may be removing the cover from backing the cap screw completely out and, of course, dismantling the entire latch mechanism.

When in place and with the latch mechanism properly assembled, the only visible sign of a connection between the entire panel 14 and the hood panel 11 are the heads of the studs 36. Such will give an appearance of a panel bolted to the tractor and such will discourage vandalism. The size of the heads on the studs 36 is such that the stud may be rotated with conventional type open-end or adjustable wrenches. There are no keys or special tools required.

We claim:

1. A latch on a cover panel for an opening in which the panel overlaps an edge portion of a wall structure forming said opening, comprising: A U-shaped channel with one long leg and one short leg and having a pair of aligned openings and with a part rigid with the long leg being internally threaded at the opening; a headed stud extending through the panel and in said channel at said openings and having a shank threadedly received in the internal threads, said stud being positioned in said panel so that when in a latched position the long leg is positioned behind and the shorter leg is positioned in front of said edge portion.

2. The invention defined in claim 1 in which the cover panel has an inwardly extending flange at said edge portion, said short leg has its free edge adjacent the flange, and said free edge is reduced at one corner so that said channel may swing freely to its latched position upon said stud being tightened to reduce the distance between the legs and to swing freely to its unlatched position when said stud is loosened.

3. The invention defined in claim 1 further characterized by a lock nut being fixed to the threaded portion of said stud adjacent an end opposite said stud head.

4. A latch on a cover panel for an opening in which the panel overlaps the edge portion of a wall structure forming said opening, and said panel has an inwardly extending flange generally normal to a surface of the cover panel, comprising: A U-shaped channel with one long leg with a free end portion behind the wall structure and one short leg with a free end adjacent the flange, said legs having a pair of aligned openings, and said long leg having an internally threaded part at its opening; a headed stud extending through the panel and said openings and having a shank threadedly received in the internal threads, said stud being positioned in said panel so that when latched the long leg is behind said edge portion and said channel is restricted in movement by said free end of said short leg contacting said flange.

5. The invention defined in claim 4 in which the free end of said short leg has a reduced corner that permits relatively free swinging movement of said channel from an unlatched to a latched position and from the latched to the unlatched position while preventing said channel from swinging beyond said latched position.

6. A side shield for a vehicle having inwardly extending flanges at its upper and lower edges, said lower flange having openings therein for receiving upwardly projecting tabs on the vehicle for securing the lower portion of the panel on the vehicle; at least one U-shaped channel with one long and one short leg with the longer of said legs adapted for seating behind a part of said vehicle and the shorter of said legs being positioned alongside the panel and adjacent the upper flange, said legs having horizontally aligned openings therein and internal threads coaxially positioned with the opening in said longer leg; a threaded stud having a head end positioned outboard of said panel and a threaded shank extending through the panel and said aligned openings and into said threads and when tightened and loosened to move said long and said short legs toward and away from one another, respectively, and said short leg having an upper edge with a rounded corner to permit said corner to move past the upper flange and for other portions of said leg upper edge to engage the upper flange as said stud is tightened.

* * * * *